United States Patent [19]

Sylvain

[11] 4,391,400

[45] Jul. 5, 1983

[54] APPARATUS FOR STORING A VARIABLE LENGTH OF STRIP

[75] Inventor: Daniel Sylvain, Saint Etienne, France

[73] Assignee: Clesid, St. Chamond, France

[21] Appl. No.: 259,642

[22] Filed: May 1, 1981

[30] Foreign Application Priority Data

May 7, 1980 [FR] France ..... 80 10215

[51] Int. Cl.[3] ..... B65H 17/42

[52] U.S. Cl. ..... 226/113; 226/104; 226/118; 226/119

[58] Field of Search ..... 226/113, 118, 119, 104

[56] References Cited

U.S. PATENT DOCUMENTS

| | | | |
|---|---|---|---|
| 2,808,258 | 10/1957 | Waychoff | 226/119 |
| 2,830,809 | 4/1958 | Motoco et al. | 271/2.2 |
| 3,130,888 | 4/1964 | Rothfuss et al. | 226/113 |
| 3,515,327 | 6/1970 | Bortmas | 226/113 |
| 3,687,348 | 8/1972 | Scheib | 226/113 |

FOREIGN PATENT DOCUMENTS

| | | | |
|---|---|---|---|
| 2139001 | 5/1972 | France | 226/113 |

*Primary Examiner*—Stuart S. Levy
*Assistant Examiner*—Lloyd D. Doigan
*Attorney, Agent, or Firm*—Daniel Patch; Suzanne Kikel

[57] ABSTRACT

A looper device of the horizontal type for forming a loop of strip for storage and intended to be used in a strip material processing line. Rollers for separating the upper strip from the lower strip of a loop formed by a moving cart are stored on the cart and are successively placed in position onto and removed from two cooperating stationary frames by a device mounted on the frames and which device is activated by a cam track located on the sides of the cart.

5 Claims, 5 Drawing Figures

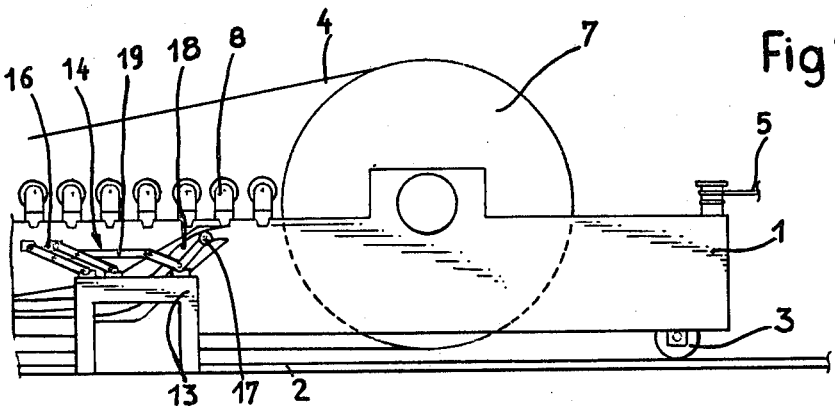
Fig 2
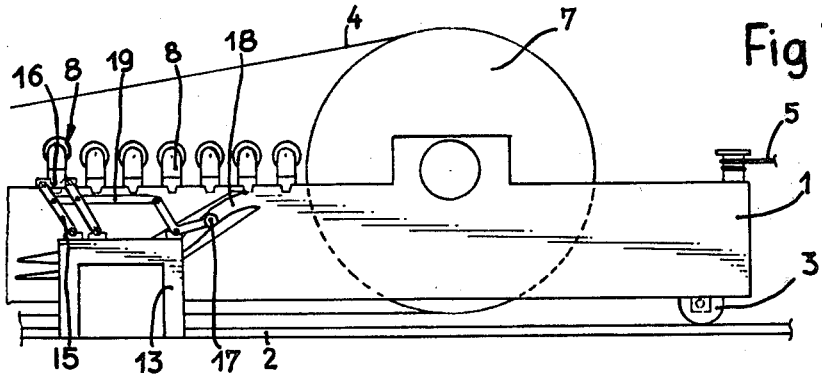
Fig 3
Fig 4
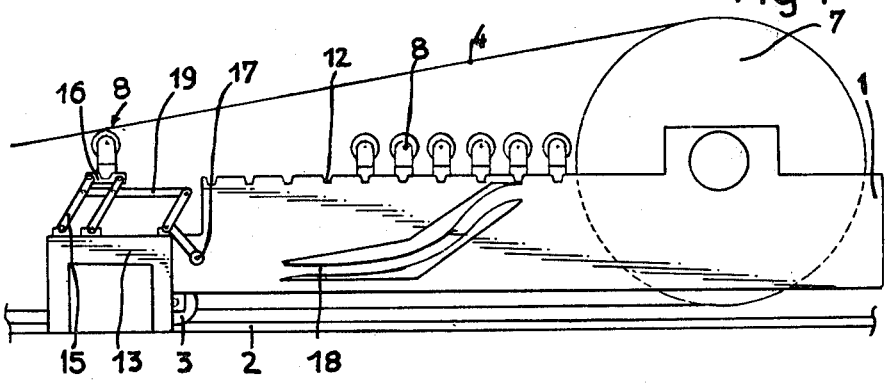

APPARATUS FOR STORING A VARIABLE LENGTH OF STRIP

This invention relates to a system for the forming of a loop intended to be used in a strip material processing line.

In most of the strip processing lines operating continuously, the line entry and line discharge sections are separated from the central section, in which the processing is accomplished, by means of strip accumulators. These accumulators are intended for the storage of the strip in order to make it possible for the section in which the processing is taking place to operate with a constant pass line velocity for the strip; and to do this even when the operation of the entry and discharge sections are interrupted in order to change the coils.

Among the various types of strip accumulators, the one which the invention relates to is the horizontal accumulator. In this type of accumulator, at least one long loop is formed or developed by means of a looping cart. In the lower part of the loop, the strip is supported by stationary rollers, while in the upper part the strip is supported by rollers which separate the upper part from the lower part of the strip. Such an accumulator is for instance, described in French Pat. No. 2,139,001 corresponding to U.S. Pat. No. 3,687,348.

Presently, there exists essentially two ways of mounting the separating rollers: the first type of mounting is based upon the use of carts which travel on the same rails as the looping cart, and which each support a roller as disclosed in U.S. Pat. Nos. 2,830,809 and 3,130,888. When the loop is being developed, the looping cart drives the first roller support cart to which it is connected by means of a chain, and this goes on up to the last cart which is connected to the frame. As the chains are picking up tension, the carts are driven. During the resorption of the loop, the roller support carts are pushed back against each other, and this is done until the loop is diminished. This solution, which works very well for the low velocity lines, is to be avoided for the high velocity lines because it is not possible to guess the exact position of a cart and the "vibrating" of the strip may result in a displacement of the carts.

The second type of mounting for the separating rollers, which is the one most frequently used, consists in cantileverly mounting rollers on arms which pivot around a vertical centerline in order to be swung into position transversely to the path of travel of the cart or parallel to this path during the passage of the looping cart. This type is similar to that disclosed in the aforementioned U.S. Pat. No. 3,687,348. The requirement to have strong separating arms leads them to be constructed in a rather bulky manner, so that the device providing for the pivoting during the passage of the cart is of a rather complex nature, and rather expensive. Furthermore, when this device breaks down, it may result in the cart colliding with an arm which has not swung out of the way of the path of travel, and this results in rather large stresses in the frame, which may lead to a permanent deformation of same.

The strip accumulator device of the horizontal type in accordance with the invention eliminates the problems of the above devices. It provides for the positioning of the separating rollers at well set locations, thus avoiding the problems resulting from the cart mounted rollers, and furthermore, for the mounting of at least two rollers onto a beam and resting on two bearing points, thus avoiding the problem corresponding to the cantilever-mounted separating arms that pivot around a vertical centerline. This invention is characterized in that the looping cart carries the separating roller assemblies and it further provides means for the successive setting and moving of said separating roller assemblies onto and from a stationary support frame located at selected locations.

The present invention shall be better appreciated and understood from the following description of a preferred embodiment in connection with the appended drawings in which:

FIGS. 2, 3 and 4 are elevational schematic diagrams of the accumulator presented in FIG. 1, showing three successive essential phases of the grasping and setting operation for one of the separating rollers;

Figure 1:
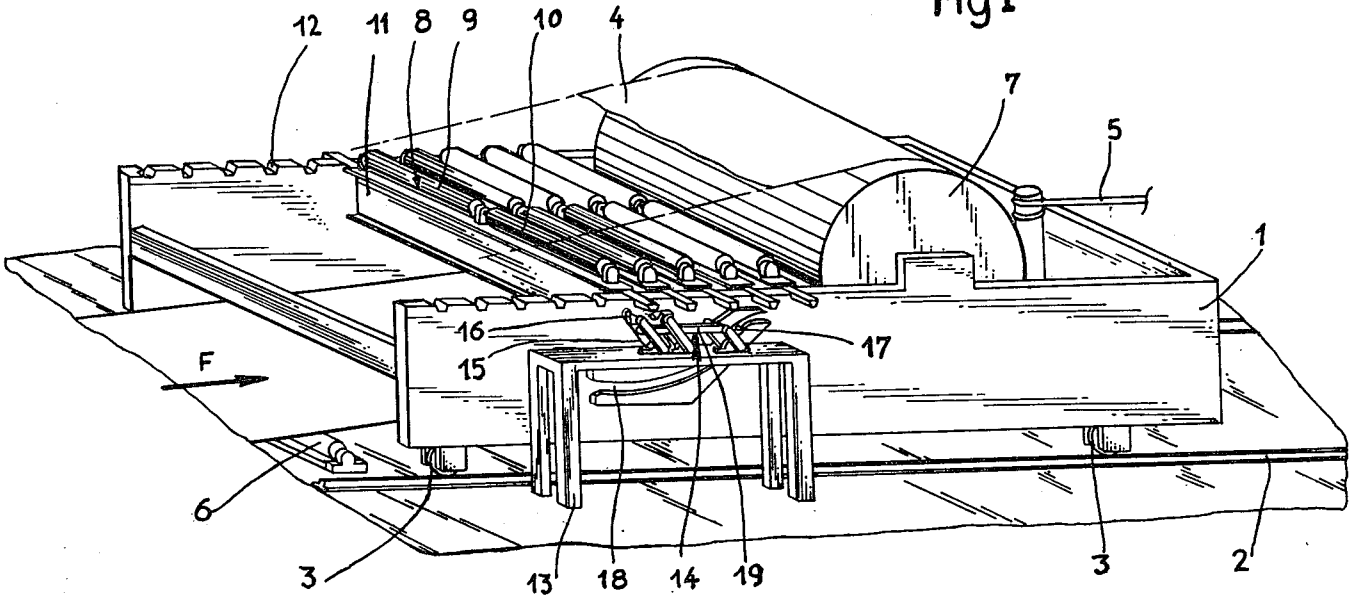
FIG. 1 is a perspective view of the strip accumulator assembly in accordance with the present invention.

Referring to FIGS. 1–4, reference 1 designates a looping cart for the strip accumulator, which moves, in the conventional manner, on rails 2 by means of wheels 3 by being pulled towards the right in FIG. 1 in the direction of enlargement of the loop of strip 4 by means of a cable 5 attached to same, or toward the left in the direction of resorption of the loop by the tensile force applied by the strip. Also in the conventional manner, the strip 4 whose lower part is supported by lower support rollers 6, passes beneath looping cart 1 around deflector drum 7 which is mounted on cart 1, and then comes back toward the rear and to the left of the FIG. 1. The return part or upper part of the strip is supported, in the conventional manner, by a set of separating roller assemblies 8, arranged relative to each other with adequate spacing between one assembly and the next, and being located above the lower support rollers 6.

In accordance with the present invention, each separating assembly 8 is constituted of two rollers 9, 10 mounted on a beam 11 which beam along with the rollers 9, 10 is stored, when not in use, in notches 12 of the looping cart 1, which notches 12 are provided for that purpose. Frame means for supporting roller assembly 8 is provided, at selected locations corresponding to the desired locations for each separator assembly 8, and consists of at least a pair of stationary frames 13 located opposite to each other on either side of the passage of the cart and therefore the strip. Each frame 13 is provided with a linkage arrangement or an articulated device 14 which is activated by the cart's passage to load and unload each separating roller assembly 8 onto and from looping cart 1, and which device 14 also acts to hold the roller assembly 8 in its carrying working position. The operation of this device 14 will be explained in detail shortly. As shown on the drawings, each articulated device 14 consists of a set of rods 15 hinged together and on which is mounted a notch piece 16 which provides for the grasping, the holding in a carrying working position, and then the releasing of a separating roller assembly 8 correspondingly onto the cart. Each rod assembly 15 is set in motion by means of a roller 17 located at the free downstream end of device 14, which rolls into a groove 18 of a cam track in the shape of an unsymmetrical "S" as shown on the drawings, and which is mounted on a side of the looping cart adjacent the frame 13. The shape of the groove 18 and the construction of device 14 are such that, when the cart moves from the left toward the right in the figures, that is to say, when the loop is being formed, the roller 17 engages itself into the top of groove 18 and transmits through horizontal rod 19 connected to rods 15 and to a linkage supporting roller 17 the movements to part 16 as shown schematically in FIG. 2 through 4: These movements are as follows: (1) Notch piece 16 is set into motion until its horizontal velocity is equal to that of cart 1 (FIG. 2); (2) Notch piece 16 is held at the horizontal velocity of the cart while its location and its movement in the vertical direction result in the raising of the separating assembly 8, as shown in FIG. 3; (3) The horizontal velocity of notch piece 16 decreases until it reaches its stopping and working position where the separating roller assembly 8 is then held (FIG. 4). When the cart is coming back from the right toward the left, that is to say during the resorption of the strip loop, i.e., when the cart moves from right to left in the FIGS. 2 through 4, these three movements of notchpiece 16 are accomplished in the reversed order. Even though one frame 13 is shown, it is understood that a number of frames are positioned selectively along and adjacent to rails 2, on both sides of cart 1, and that two transverse opposed frames 13 cooperate to support a roller assembly 8.

The length of horizontal rod 19 for each hinged device 15 varies depending upon its location along rails 2, and it is such that each notchpiece 16 grasps a corresponding separating assembly 8 provided for it on cart 1. Between two successive aligned devices 14, the difference in the length of horizontal rod 19 corresponds to the distance separating two successive notches 12 which support two successive roller assemblies 8 on cart 1.

Each separating assembly 8 supported by a device 14, once in its high working position as shown in FIG. 4, is advantageously locked in that position by a locking device, not shown in FIGS. 1 through 4 in order to simplify the drawings. This locking of roller assembly 8 and device 14 provides for good stability for the upper strip supporting arrangement even in the case where the strip is vibrating. The accessory locking device which is used in the embodiment under consideration shall be described in reference to FIG. 5.

Figure 5:
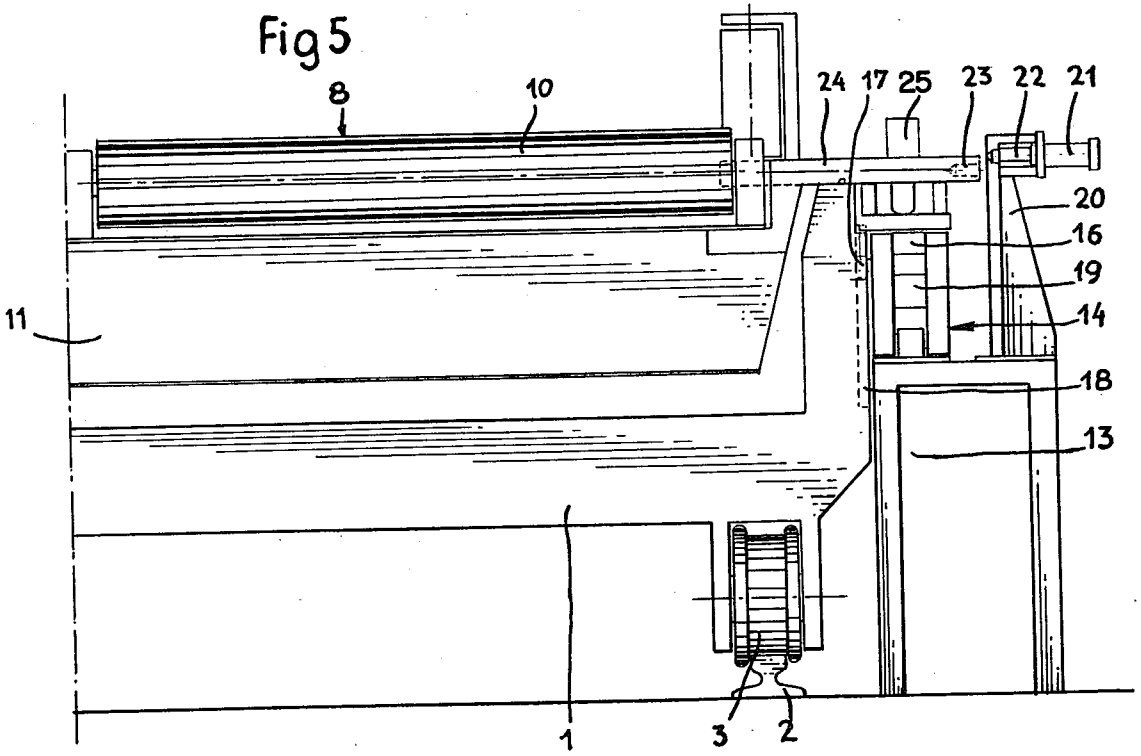
FIG. 5 is a partial front view along direction F shown in FIG. 1, presenting a locking assembly for a separating roller assembly in the position shown in FIGS. 1 and 2.

FIG. 5 shows part 16 in the position for the lifting of the separating assembly 8, in the position shown in FIGS. 1 and 2. A device 20 for the locking of the hinged system 14 in its carrying position of separating assembly 8 is mounted on frame 13. This device mainly comprises a pneumatic jack 21, set in an horizontal or transversal position in such a manner that its rod 22, upon its extension out of jack 21 and when the separating assembly 8 is in its carried position can enter a cavity 23 having a corresponding shape and drilled in bar 24. Bar 24 constitutes the bearing end of beam 11. Furthermore, a pneumatic dampener 25 is attached to the end of bar 24 to provide for the dampening of the impact resulting from the vertical forces which might develop during the releasing of separating assemblies 8 from their respective devices 14.

In the preferred embodiment described above, device 14 providing for the setting and the releasing of the separating assemblies 8 are mounted on the frame 13. It goes without saying that, without leaving the scope of the invention a single device can be mounted on the cart itself. It would then be set in motion as in the previous case by means of "S" grooves located on the frame, and would have the function of grasping each separating assembly 8, setting it in the high position in notches, or facsimiles, provided in the frame, and then releasing it in order to bring it down to a low position onto the cart, in wait for the next separating assembly. An accessory system, such as a device frequently used for the overall transfer over a small distance of a complete set of rolled bars in the rolling mill discharge coolers, would horizontally move by one notch upstream the set of separators remaining on the cart. Of course, these operations would reversely occur upon the return of the cart or the diminishing of the strip loop.

In accordance with the provisions of the patent statutes, I have explained the principle and operation of my invention and have illustrated and described what I consider to represent the best embodiment thereof.

I claim:

1. A strip accumulator system of the horizontal type, comprising:

a cart having means for engaging a strip in a fashion to form a horizontal loop, and constructed and arranged to be motivated along a path of travel to increase or decrease the length of said loop, a number of roller assemblies for supporting and separating an upper portion from a lower portion of said strip of said formed loop, said cart including means for storing said roller assemblies thereon, a number of stationary cooperative sets of frames transversely opposed relative to said strip and spaced at selected locations parallel to and on opposite sides of said path of travel in a manner to permit free movement of said cart therealong, and means activated by said motion of said cart, for the successive removal of said roller assemblies off of said cart and placement thereof onto a different one of said sets of transversely opposed frames and into a working position to support said upper portion of said strip upon said increase of said loop and for successive removal of said roller assemblies from said sets of frames onto said cart upon said decrease of said loop.

2. A strip accumulator system according to claim 1 further comprising:

a locking means for securing each of said roller assemblies in said working position.

3. A strip accumulator system according to claims 1 or 2 further comprising:

means for effecting a dampening of forces during said placement and removal of each of said roller assemblies onto and off of said each set of opposed frames.

4. A strip accumulator system according to claims 1 or 2:

wherein said cart has at least two sides located transversely opposite to each other relative to said path of travel, wherein said storing means includes a series of notches extending along said sides of said cart wherein each notch cooperates with a notch located directly opposite thereof, wherein each said roller assembly consists of at least one roller mounted through bearings onto a beam which extends the transverse direction of said cart and overhangs said notches when engaged therein, and wherein said placement and removal means comprises a cam track having a groove and mounted on each said notched sides of said cart, a cam follower for engaging said groove of said cam track, and linkage means carried by each said stationary frame for supporting opposite ends of said beam and for mounting said cam follower.

5. A strip accumulator according to claim 4 wherein said each said linkage means includes a generally horizontal rod and wherein when considering two sets of successive stationary frames, the length difference of their respective generally horizontal rods corresponds to the distance separating two successive said notches on said notched sides of said cart.

* * * * *